US006918332B1

(12) United States Patent
Andersen

(10) Patent No.: US 6,918,332 B1
(45) Date of Patent: Jul. 19, 2005

(54) PAPER PUNCH DEVICE

(76) Inventor: Gaynelle Andersen, 624 Spencer St. #2, Monterey, CA (US) 93940

( * ) Notice: Subject to any disclaimer, the term of this patent is extended or adjusted under 35 U.S.C. 154(b) by 24 days.

(21) Appl. No.: 10/724,504

(22) Filed: Dec. 1, 2003

(51) Int. Cl.[7] ..... B26D 5/10

(52) U.S. Cl. ..... 83/589; 83/954; 83/167; 83/605; 83/633; 83/684; 83/686; 30/358

(58) Field of Search ..... 83/954, 167, 568, 83/585, 589, 605, 633, 684–686, 690, 694, 83/697, 698.91; 30/358, 363

(56) References Cited

U.S. PATENT DOCUMENTS

| | | | | | |
|---|---|---|---|---|---|
| 3,015,161 | A | | 1/1962 | Semler et al. | |
| 3,194,103 | A | * | 7/1965 | Gilman | 83/589 |
| 3,308,699 | A | * | 3/1967 | Illingworth et al. | 83/133 |
| 3,362,271 | A | * | 1/1968 | Willis | 83/146 |
| 3,392,447 | A | | 7/1968 | Hendricks et al. | |
| 3,628,407 | A | * | 12/1971 | Adams | 83/140 |
| 3,859,726 | A | * | 1/1975 | Mitsunari | 30/358 |
| 4,036,088 | A | * | 7/1977 | Ruskin | 83/167 |
| 4,987,683 | A | | 1/1991 | Brych | |
| 2,191,382 | A | | 2/1995 | Hart | |
| 5,386,638 | A | | 2/1995 | Weber | |
| D364,411 | S | * | 11/1995 | Wang | D15/128 |
| 5,495,671 | A | * | 3/1996 | Shun-Yi | 30/364 |
| 5,601,006 | A | * | 2/1997 | Quinn et al. | 83/588 |
| 5,697,278 | A | * | 12/1997 | Shun-Yi | 83/588 |
| 6,739,244 | B1 | * | 5/2004 | Carbaugh | 101/3.1 |

* cited by examiner

*Primary Examiner*—Boyer D. Ashley

(57) ABSTRACT

A paper punch device includes an elongate base having a first end, a second end, a top side and a length greater than nine inches. A compartment is positioned within the base. An aperture positioned adjacent to the first end extends through the top side into the compartment. An engaging arm is elongated and has rearward end and a forward end. The rearward end is pivotally coupled to the top side adjacent to the second end and the engaging arm extends over the aperture. A piston extends through and is movably mounted in the engaging arm. The piston includes a lower portion that may selectively be extended through the aperture. A first biasing member biases the lower portion upwardly away from the base. An actuator selectively moves the lower portion of the piston downward and into the aperture.

9 Claims, 5 Drawing Sheets

PAPER PUNCH DEVICE

BACKGROUND OF THE INVENTION

1. Field of the Invention

The present invention relates to paper punch devices and more particularly pertains to a new paper punch device for selectively positioning punched holes in paper away from the edge of the paper.

2. Description of the Prior Art

The use of paper punch devices is known in the prior art. U.S. Pat. No. 2,191,386 describes a device punching holes through paper. Other types of paper punch devices include U.S. Pat. No. 5,386,638 and U.S Pat. No. 3,015,161.

While these devices fulfill their respective, particular objectives and requirements, the need remains for a device that allows a use to punch holes through a portion of paper that is positioned away from the edge of the paper. This will allow a person to make hole punches for decorative effects as well as for conventional purposes. Also, it would be beneficial if such a device allowed a user to replaced the hole-punching members so that alternative shapes could be formed when punching the paper.

SUMMARY OF THE INVENTION

The present invention meets the needs presented above by generally comprising an elongate base having a first end, a second end, a first side edge, a second side edge, a top side and a bottom side. A compartment is positioned within the base. The top side has an aperture extending therethrough and into the compartment. The aperture is positioned generally adjacent to the first end. The base has a length from the first end to the second end greater than nine inches. An engaging arm is elongated and has rearward end and a forward end. The rearward end is pivotally coupled to the top side of the base and positioned adjacent to the second end such that the engaging arm extends over the aperture. A piston extends through and is movably mounted in the engaging arm. The piston includes an upper portion extending upwardly from the engaging arm and a lower portion extending downwardly from the engaging arm. The piston is positioned such that the piston may selectively extend through the aperture. A first biasing member is coupled to the piston for biasing the lower portion upwardly away from the base. A second biasing member is coupled to the engaging arm for biasing the forward end of the engaging arm upwardly away from the base. An actuator for selectively moving the lower portion of the piston downward and into the aperture is attached to the engaging arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
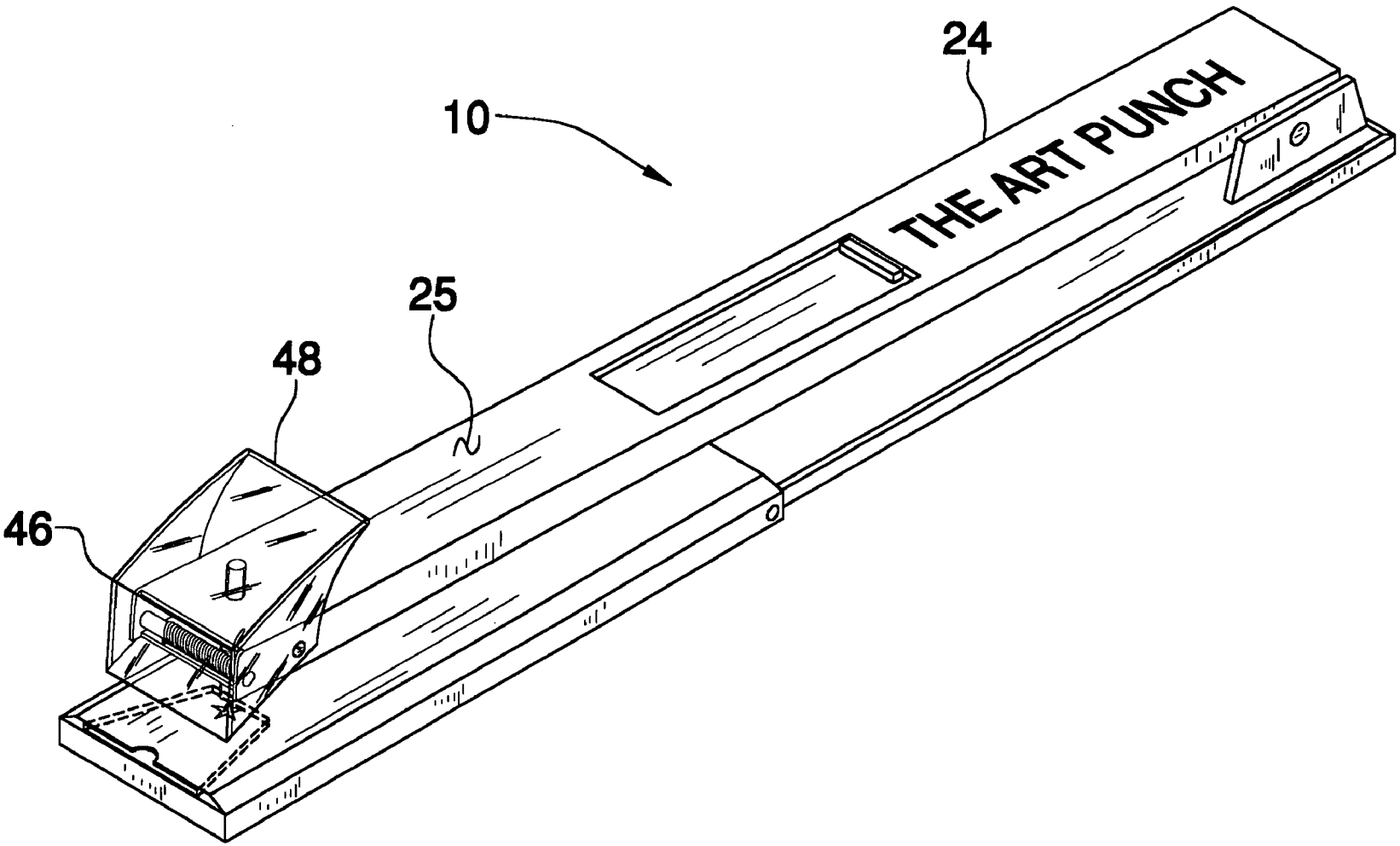
FIG. 1 is a schematic perspective view of a paper punch device according to the present invention.
Figure 2:
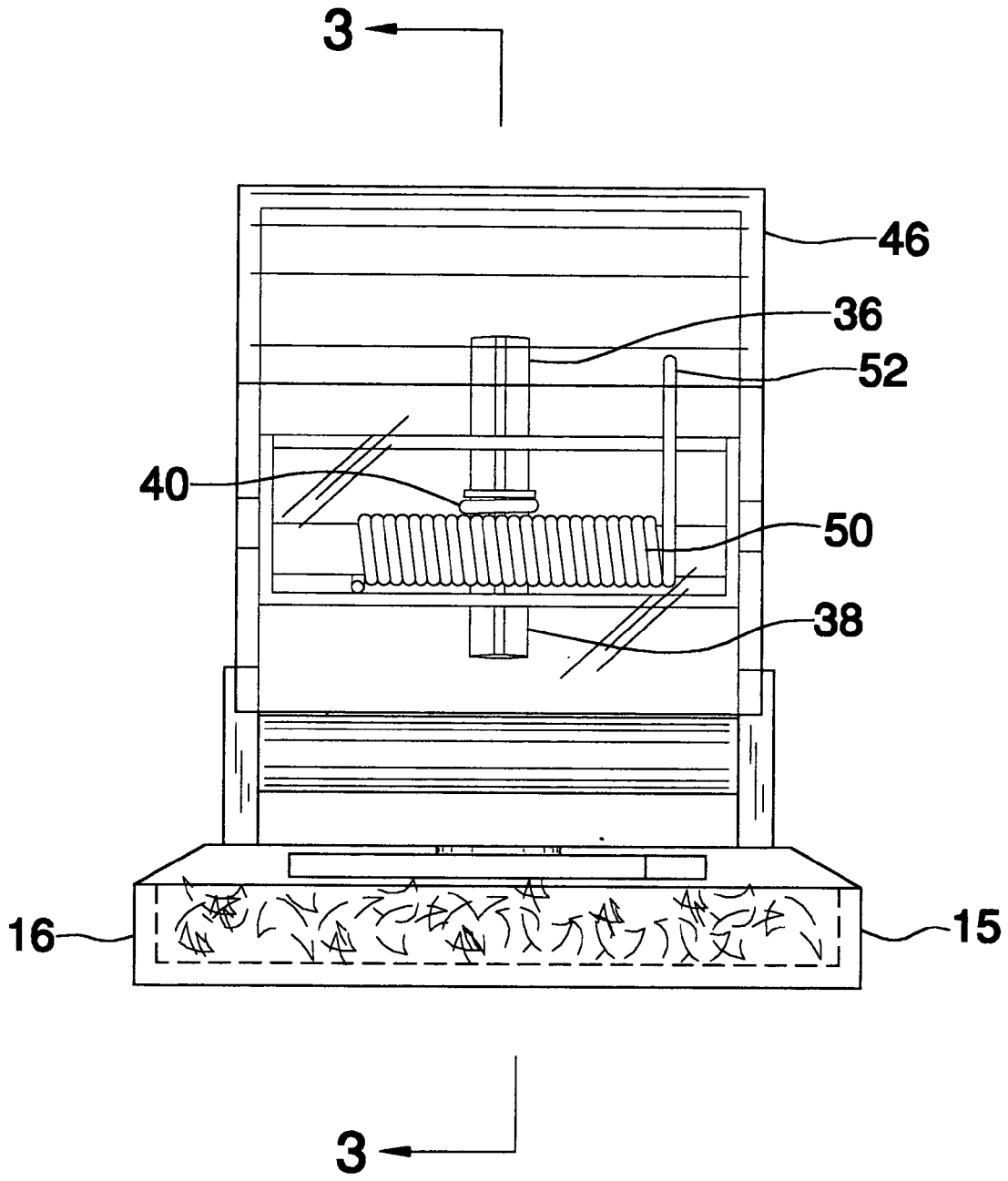
FIG. 2 is a schematic front view of the present invention.
Figure 3:
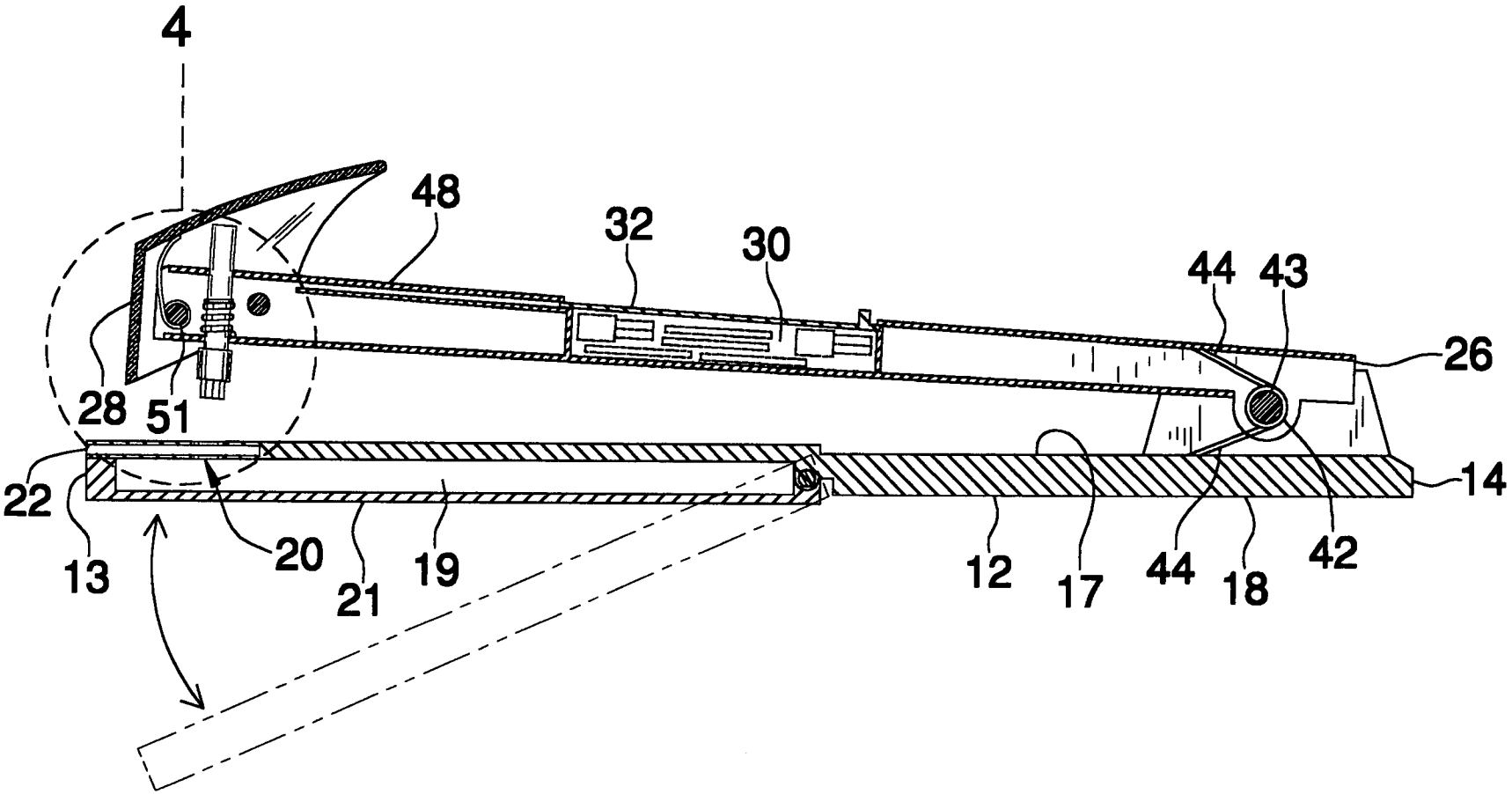
FIG. 3 is a schematic cross-sectional view taken along line 3—3 of FIG. 2 of the present invention.
Figure 4:
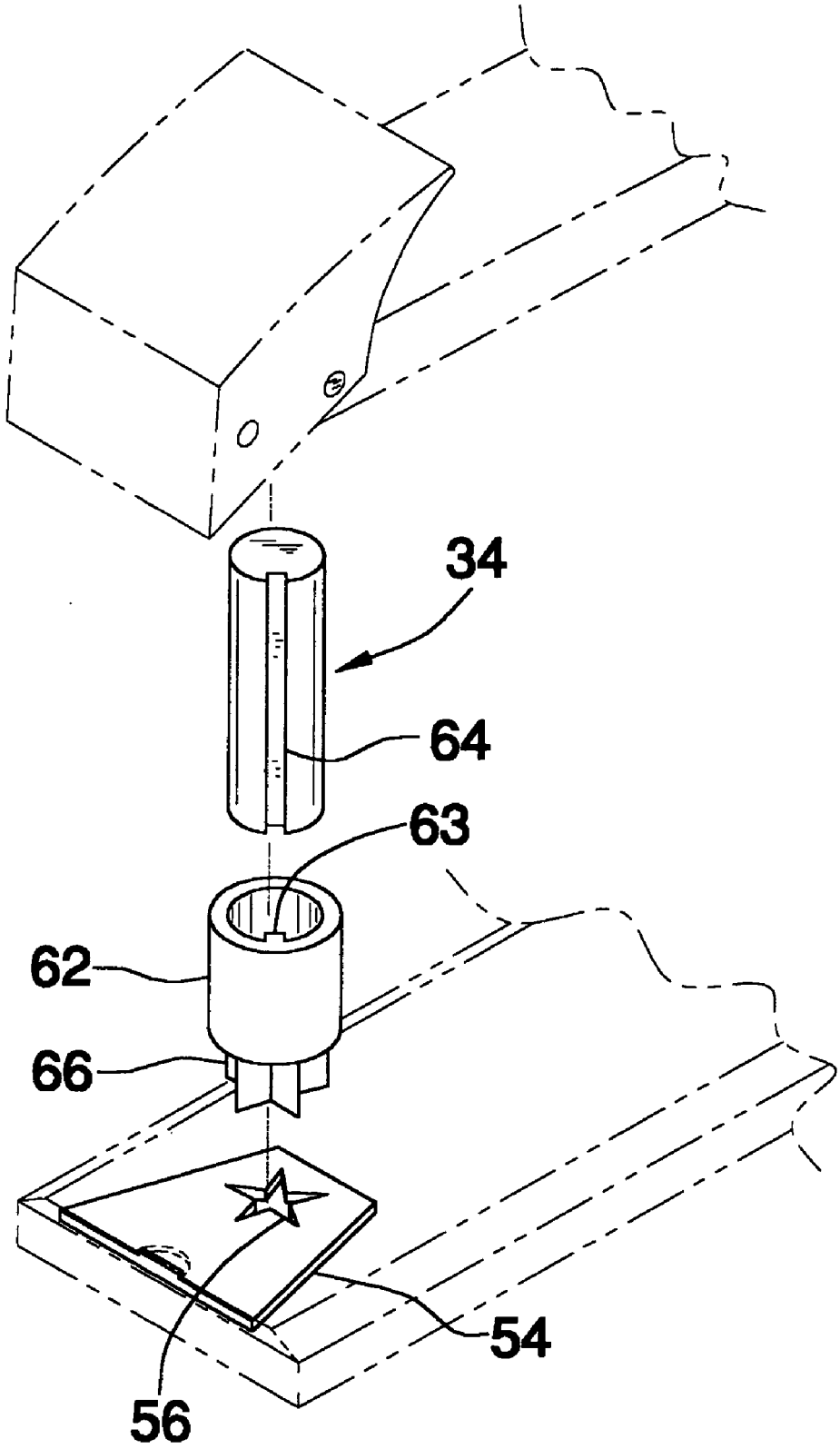
FIG. 4 is a schematic perspective expanded view of the present invention.
Figure 5:
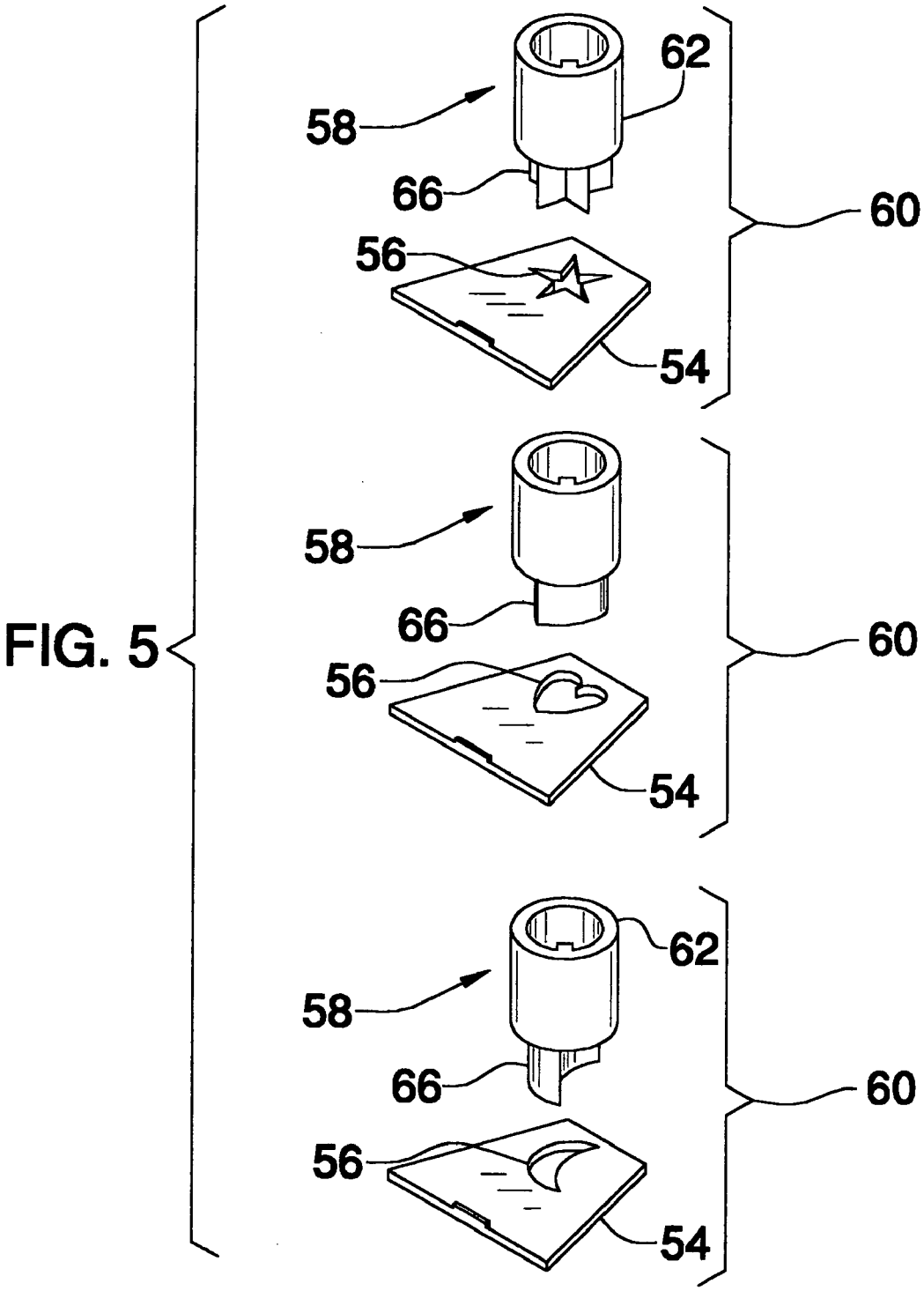
FIG. 5 is a schematic perspective view of template and punch member pairs of the present invention.

With reference now to the drawings, and in particular to FIGS. 1 through 5 thereof, a new paper punch device embodying the principles and concepts of the present invention and generally designated by the reference numeral 10 will be described.

As best illustrated in FIGS. 1 through 5, the paper punch device 10 generally comprises an elongate base 12 having a first end 13, a second end 14, a first side edge 15, a second side edge 16, a top side 17 and a bottom side 18. A compartment 19 is positioned within the base 12. The compartment 19 extends toward the first end 13. The top side 17 has an aperture 20 extending therethrough and into the compartment 19. The aperture 20 is positioned generally adjacent to the first end 13. A proximate portion of the bottom side with respect to the first end defines a door 21 for selectively opening or closing the compartment 19. The base 12 has a length from the first end 13 to the second end 14 greater than nine inches. The first end 13 has a template receiving slot 22 therein and traversing the aperture 20.

An engaging arm 24 is elongated and has rearward end 26 and a forward end 28. The rearward end 26 is pivotally coupled to the top side 17 of the base 12 and positioned adjacent to the second end 14 such that the engaging arm 24 extends over the aperture 20. The engaging arm 24 has a cavity 30 therein positioned between the rearward 26 and forward 28 ends. A covering 32 is selectively positioned over the cavity 30 for opening or closing the cavity 30.

A piston 34 extends through and is movably mounted in the engaging arm 24. The piston 34 includes an upper portion 36 extending upwardly from the engaging arm 24 and a lower portion 38 extending downwardly from the engaging arm 24. The piston 34 is positioned such that the piston 34 may selectively extend through the aperture 20.

A first biasing member 40 is coupled to the piston 34 for biasing the lower portion 38 upwardly away from the base 12. The first biasing 40 member preferably includes a spring wound about the piston 34 and positioned within the engaging arm 24. A second biasing member 42 is coupled to the engaging arm 24 for biasing the forward end 28 of the engaging arm 24 upwardly away from the base 12. The second biasing 42 member preferably includes a spring wound about a pivot member 43 and includes opposite ends 44 biasing the engaging arm 24 away from the base 12.

An actuator 46 for selectively moving the lower portion 38 of the piston 34 downward and into the aperture 20 is attached to the engaging arm 24. The actuator 46 comprises a lever pivotally coupled to the engaging arm 24 so that the lever, or actuator 46, extends over the upper portion 36 of the piston 34. The lever 46 has a free end 48 that extends upwardly and generally toward the rearward end 26 of the engaging arm 24. The lower portion 38 of the piston 34 is moved into the aperture 20 when the free end 48 is selectively moved toward an upper surface 25 of the engaging arm 24. A third biasing member 50 is attached to the engaging arm 24 for biasing the lever 46 upwardly away from the piston 34. The third biasing member 50 is preferably a spring wound about a column 51 on the engaging arm and has a free end 52 abutted against, and biasing upwardly, the lever 46.

The device 10 includes a plurality of template 54 and punch member 58 paired combinations 60. Each of the templates 54 comprises a rigid panel having an opening 56 extending therethrough. Each of the templates 54 is selectively positionable into the template receiving slot 22 such that the opening 56 is aligned with the aperture 20. The openings 56 each have a different shape. The shapes may include, but are not limited to, crescents, hearts and stars. Each of the punch members 58 includes a female coupler 62 and a cutting member 66. The female couplers 62 are selectively coupled to the lower portion 38 of the piston 34. The female couplers 62 preferably have flange 63 for frictionally engaging a slot 64 in the piston 34 when the piston 34 is extended into the female coupler 62. Each of the cutting members 66 has a size and shape substantially identical to the shape of one of the openings 56.

In use, the device 10 is used for positioning paper punches, as desired, anywhere on conventionally sized paper. The length of the base 12 and engagement arm 24 allows for positioning hole punches in the center of paper having a width in excess of 14 inches. The user places the paper between the piston 34 and the aperture 20 and uses the actuator 46 to press the piston 34 through the paper and into the aperture 20. If a specific shape is desired, the templates 54 are placed the template receiving slot 22 and the corresponding punching member 58 attached to the piston. When the actuator 46 is then used, the cutting member 66 extends through the opening 56 and into the aperture 20 to leave a hole in the paper having the same shape as the opening 56. It is preferred that the female couplers 62 have a greater diameter than the cutting members 66 to ensure that that female couplers 62 do not extend into the openings 56. The paper scraps are caught in the compartment 19 and may be emptied therefrom by opening the door 21. The cavity 30 is used as a storage place for the templates 54 and punch members 58.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hole punching device for selectively punching holes through a paper material, said device comprising:

an elongate base having a first end, a second end, a first side edge, a second side edge, a top side and a bottom side, a compartment being positioned within said base, said top side having an aperture extending therethrough and into said compartment, said aperture being positioned generally adjacent to said first end, said base having a length from said first end to said second end greater than nine inches;

an engaging arm being elongated and having rearward end and a forward end, said rearward end being pivotally coupled to said top side of said base and positioned adjacent to said second end such that said engaging arm extends over said aperture;

a piston extending through and being movably mounted in said engaging arm, said piston including an upper portion extending upwardly from said engaging arm and a lower portion extending downwardly from said engaging arm, said piston being positioned such that said piston may selectively extend through said aperture;

a first biasing member being coupled to said piston for biasing said lower portion upwardly away from said base;

a second biasing member being coupled to said engaging arm for biasing said forward end of said engaging arm upwardly away from said base; and an actuator for selectively moving said lower portion of said piston downward and into said aperture being attached to said engaging arm, said actuator comprising a lever pivotally coupled to said engaging arm and extending over said upper portion of said piston, said lever having a free end extending generally toward said rearward end of said engaging arm, wherein said lower portion is moved into said aperture when said free end is selectively moved toward an upper surface of the engaging arm.

2. The device of claim 1, wherein a proximate portion of said bottom side with respect to said first end defines a door for selectively opening or closing said compartment.

3. The device of claim 1, wherein said engaging arm has a cavity therein positioned between said rearward and forward ends, a covering being selectively positioned over said cavity for opening or closing said cavity.

4. The device of claim 1, further including a third biasing member being attached to said engaging arm for biasing said actuator upwardly away from said piston.

5. The device of claim 1, wherein said first end of said base has a template receiving slot therein and traversing said aperture and said device further includes a plurality of template and punch member paired combinations, each of said templates comprising a panel having an opening extending therethrough, each of said templates being selectively positionable into said template receiving slot such that said opening is aligned with said aperture, each of said openings having a different shape, each of said punch members being selectively coupled to said piston and having a shape adapted for creating a punch having the shape of the opening of a paired one of said templates.

6. The device of claim 5, wherein each of said punch members includes a female coupler and a cutting member, each of said female couplers being selectively coupled to said lower portion of said piston, each of said cutting members having a shape substantially identical to the shape of one of said openings.

7. A hole punching device for selectively punching holes through a paper material, said device comprising:

an elongate base having a first end, a second end, a first side edge, a second side edge, a top side and a bottom side, a compartment being positioned within said base, said compartment extending toward said first end, said top side having an aperture extending therethrough and into said compartment, said aperture being positioned generally adjacent to said first end, a proximate portion of said bottom side with respect to said first end defining a door for selectively opening or closing said compartment, said base having a length from said first end to said second end greater than nine inches, said first end having a template receiving slot therein and traversing said aperture;

an engaging arm being elongated and having rearward end and a forward end, said rearward end being pivotally coupled to said top side of said base and positioned adjacent to said second end such that said engaging arm extends over said aperture, said engaging arm having a cavity therein positioned between said rearward and forward ends, a covering being selectively positioned over said cavity for opening or closing said cavity;

a piston extending through and being movably mounted in said engaging arm, said piston including an upper portion extending upwardly from said engaging arm and a lower portion extending downwardly from said engaging arm, said piston being positioned such that said piston may selectively extend through said aperture;

a first biasing member being coupled to said piston for biasing said lower portion upwardly away from said base;

a second biasing member being coupled to said engaging arm for biasing said forward end of said engaging arm upwardly away from said base;

an actuator for selectively moving said lower portion of said piston downward and into said aperture being attached to said engaging arm, said actuator comprising a lever pivotally coupled to said engaging arm and extending over said upper portion of said piston, said lever having a free end extending generally toward said rearward end of said engaging arm, wherein said lower portion is moved into said aperture when said free end is selectively moved toward an upper surface of the engaging arm;

a third biasing member being attached to said engaging arm for biasing said actuator upwardly away from said piston; and a plurality of template and punch member paired combinations, each of said templates comprising a panel having an opening extending therethrough, each of said templates being selectively positionable into said template receiving slot such that said opening is aligned with said aperture, each of said openings having a different shape, each of said punch members including a female coupler and a cutting member, each of said female couplers being selectively coupled to said lower portion of said piston, each of said cutting members having a size and shape substantially identical to the shape of one of said openings.

8. A hole punching device for selectively punching holes through a paper material, said device comprising:

an elongate base having a first end, a second end, a first side edge, a second side edge, a top side and a bottom side, a compartment being positioned within said base, said top side having an aperture extending therethrough and into said compartment, said aperture being positioned generally adjacent to said first end, said base having a length from said first end to said second end greater than nine inches, said first end of said base having a template receiving slot therein and traversing said aperture;

an engaging arm being elongated and having rearward end and a forward end, said rearward end being pivotally coupled to said top side of said base and positioned adjacent to said second end such that said engaging arm extends over said aperture;

a piston extending through and being movably mounted in said engaging arm, said piston including an upper portion extending upwardly from said engaging arm and a lower portion extending downwardly from said engaging arm, said piston being positioned such that said piston may selectively extend through said aperture;

a first biasing member being coupled to said piston for biasing said lower portion upwardly away from said base;

a second biasing member being coupled to said engaging arm for biasing said forward end of said engaging arm upwardly away from said base;

an actuator for selectively moving said lower portion of said piston downward and into said aperture being attached to said engaging arm; and a plurality of template and punch member paired combinations, each of said templates comprising a panel having an opening extending therethrough, each of said templates being selectively positionable into said template receiving slot such that said opening is aligned with said aperture, each of said openings having a different shape, each of said punch members being selectively coupled to said piston and having a shape adapted for creating a punch having the shape of the opening of a paired one of said templates.

9. The device of claim 8, wherein each of said punch members includes a female coupler and a cutting member, each of said female couplers being selectively coupled to said lower portion of said piston, each of said cutting members having a shape substantially identical to the shape of one of said openings.

* * * * *